US005510218A

United States Patent [19]

Nakata et al.

[11] Patent Number: 5,510,218

[45] Date of Patent: Apr. 23, 1996

[54] ELECTROPHOTOGRAPHIC PHOTOSENSITIVE MEMBER, PROCESS CARTRIDGE USING SAME AND ELECTROPHOTOGRAPHIC APPARATUS

[75] Inventors: Kouichi Nakata; Toshihiro Kikuchi, both of Yokohama; Akihiro Senoo; Tetsuro Kanemaru, both of Tokyo, all of Japan

[73] Assignee: Canon Kabushiki Kaisha, Tokyo, Japan

[21] Appl. No.: 271,502

[22] Filed: Jul. 7, 1994

[30] Foreign Application Priority Data

Jul. 9, 1993 [JP] Japan ..... 5-170460

[51] Int. Cl.[6] ..... G03G 5/047

[52] U.S. Cl. ..... 430/59; 355/271; 430/83

[58] Field of Search ..... 430/59, 83; 355/271

[56] References Cited

U.S. PATENT DOCUMENTS

| | | | |
|---|---|---|---|
| 3,824,099 | 7/1974 | Champ et al. | 96/1.5 |
| 4,123,269 | 10/1978 | Van Hoene et al. | 96/1 PC |
| 4,150,987 | 4/1979 | Anderson et al. | 96/1.5 |
| 4,898,800 | 2/1990 | Shimada et al. | 430/59 |
| 5,049,464 | 9/1991 | Kanemaru et al. | 430/59 |
| 5,098,809 | 3/1992 | Kikuchi et al. | 430/73 |
| 5,227,271 | 7/1993 | Kikuchi et al. | 430/59 |
| 5,238,765 | 8/1993 | Senoo et al. | 430/73 |
| 5,262,261 | 11/1993 | Kikuchi et al. | 430/59 |

FOREIGN PATENT DOCUMENTS

| | | |
|---|---|---|
| 0504794 | 9/1992 | European Pat. Off. . |
| 52-4188 | 2/1977 | Japan . |
| 55-42380 | 10/1980 | Japan . |
| 57-195254 | 11/1982 | Japan . |
| 58-32372 | 7/1983 | Japan . |
| 58-198043 | 11/1983 | Japan . |
| 61-132955 | 6/1986 | Japan . |
| 55-52063 | 4/1990 | Japan . |
| 3-78756 | 4/1991 | Japan . |

*Primary Examiner*—John Goodrow

*Attorney, Agent, or Firm*—Fitzpatrick, Cella, Harper & Scinto

[57] ABSTRACT

An electrophotographic photosensitive member is constituted by disposing a photosensitive layer on an electroconductive support. The photosensitive layer is characterized by containing an arylamine compound having specific two fluorenyl groups. The photosensitive member is suitable for providing an electrophotographic apparatus showing excellent electrophotographic characteristics such as a high photosensitivity, a good potential stability in repetitive use, a decreased pause memory, and no crack in the photosensitive layer.

7 Claims, 2 Drawing Sheets

ELECTROPHOTOGRAPHIC PHOTOSENSITIVE MEMBER, PROCESS CARTRIDGE USING SAME AND ELECTROPHOTOGRAPHIC APPARATUS

FIELD OF THE INVENTION AND RELATED ART

The present invention relates to an electrophotographic photosensitive member (hereinafter, sometimes referred to as "photosensitive member"), particularly to a photosensitive member having a photosensitive layer containing a specific arylamine compound.

The present invention also relates to a process cartridge and electrophotographic apparatus respectively using the photosensitive member.

There have been known many photosensitive members having a laminate-type structure, wherein a photosensitive layer comprises a charge generation layer (CGL) containing a charge-generating material (CGM) such as organic photoconductive dyes or pigments and a charge transport layer (CTL) containing a charge-transporting material (CTM) (i.e., so-called "function-separation type photosensitive member"). Such a function-separation type photosensitive member has brought about a considerable improvement on a conventional organic photosensitive member possessing defects such as low sensitivity and poor durability.

The function-separation type photosensitive member allows a wide latitude in selecting a CGM and a CTM. As a result, it is possible to prepare readily a photosensitive member having desired electrophotographic characteristics.

As examples of the CTM, there have been known various materials including: a pyrazoline compound as disclosed in Japanese Patent Publication (JP-B) No. 4188/1977; a hydrazone compound as disclosed in JP-B 42380/1980 or Japanese Laid-Open Patent Application (JP-A) No. 52063/1980; a triphenylamine compound as disclosed in JP-B 32372/1983 or JP-A 132955/1986; a stilbene compound as disclosed in JP-A 151955/1979 or JP-A 198043/1983; and an arylamine compound as disclosed in JP-A 78756/1991.

Characteristics required for the CTM may include:

(i) Stability against light and/or heat, (ii) Stability against ozone, NOx and nitric acid generated by corona discharge, (iii) High charge (carrier)-transporting ability, (iv) Good compatibility with an organic solvent and/or a binder resin, (v) Ease of production and inexpensive.

In recent years, the photosensitive member has encountered a new problem of "pause memory phenomenon" which is one of deterioration phenomena caused by corona products. More specifically, a pause memory phenomenon is such a phenomenon that a chargeability of the photosensitive member at a part facing a corona charging device is decreased when the rotation of the photosensitive member is ceases or terminates after repetitive copying thereby decreasing image density at the part in the case of a normal development system or increasing an image density at the part in the case of a reversal development system. Such a phenomenon is liable to occur after repetitive use for a long period of time.

In addition, photosensitive members possess many defects to be remedied, including an occurrence of cracks such that a charge transport layer is cracked which causes image defects in some cases when the photosensitive member is used for a long period of time within a copying machine or a laser beam printer.

In order to realize further improvements in image quality and durability, a practical photosensitive member is required to satisfy the above-mentioned characteristics at a higher level.

SUMMARY OF THE INVENTION

An object of the present invention is to provide an electrophotographic photosensitive member having a high photosensitivity and maintaining an excellent stability of electrophotographic characteristics through repetitive use.

Another object of the present invention is to provide an electrophotographic photosensitive member having a photosensitive layer containing a charge-transporting material which is readily synthesized and is inexpensively provided.

Another object of the present invention is to provide an electrophotographic photosensitive member having a decreased phase memory.

Another object of the present invention is to provide an electrophotographic photosensitive member having no cracks in a charge transport layer even when a protective layer is formed on a photosensitive layer or the photosensitive member is used or kept within an apparatus such as a copying machine or a laser beam printer.

A further object of the present invention is to provide a process cartridge and an electrophotographic apparatus respectively including the electrophotographic photosensitive member.

According to the present invention, there is provided an electrophotographic photosensitive member, comprising: an electroconductive support and a photosensitive layer disposed on the electroconductive support, wherein The photosensitive layer contains an arylamine compound represented by the following

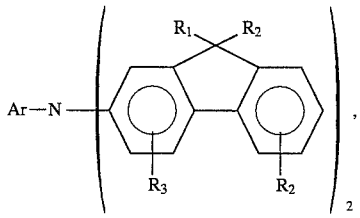

(I)

wherein Ar denotes substituted or unsubstituted aryl group or substituted or unsubstituted heterocyclic group; $R_1$ and $R_2$ independently denote substituted or unsubstituted alkyl group, substituted or unsubstituted aralkyl group, or substituted or unsubstituted aryl group, $R_1$ and $R_2$ being capable of forming a ring by connection thereof; and $R_3$ and $R_4$ independently denote hydrogen atom, halogen atom, substituted or unsubstituted alkyl group, substituted or unsubstituted alkoxy group, or substituted or unsubstituted aryl group.

According to the present invention, there is also provided a process cartridge and an electrophotographic apparatus respectively including the above-mentioned electrophotographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
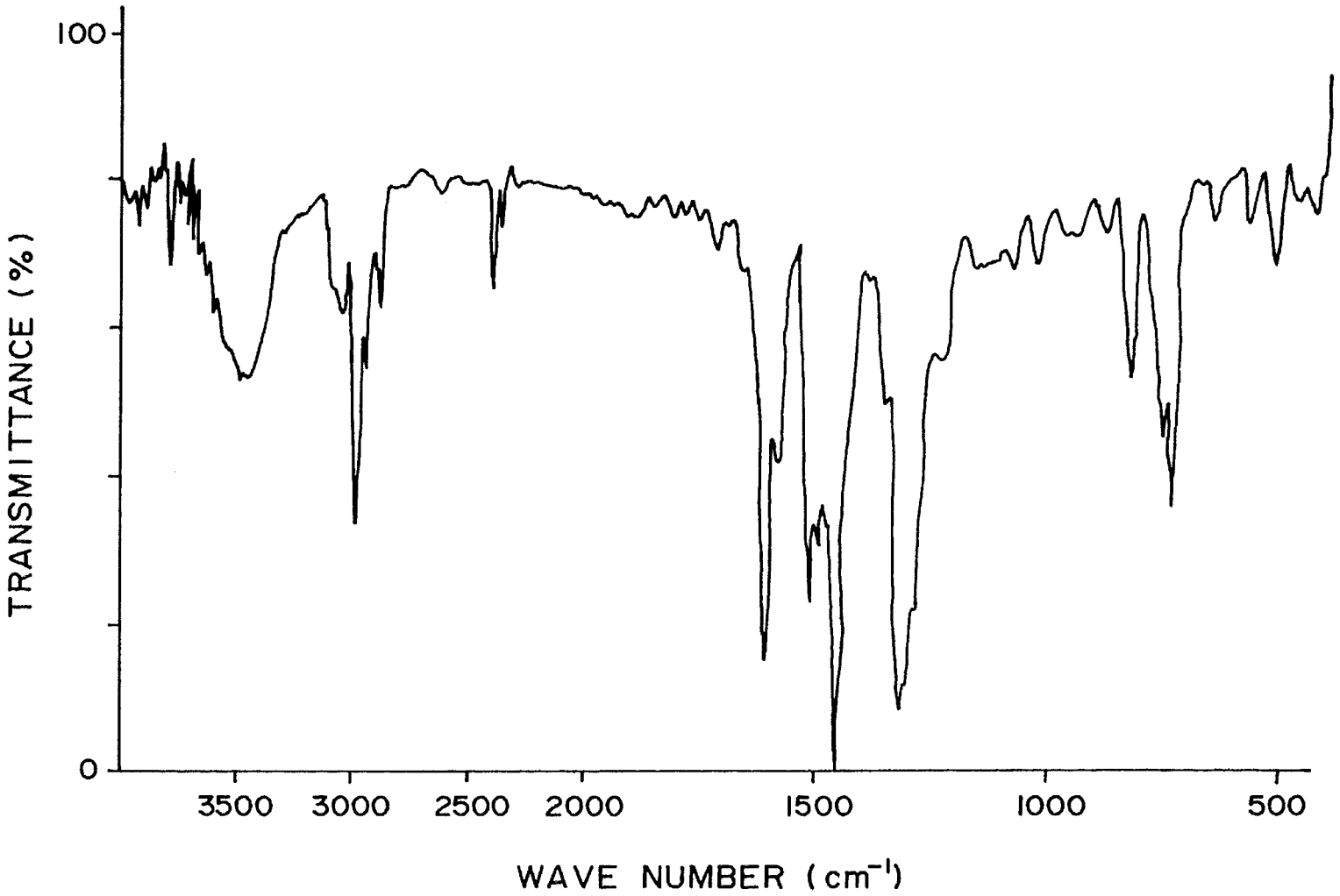
FIG. 1 is a graph showing an infrared absorption spectrum of an arylamine compound (Ex. Comp. No. (2)) used in the present invention.

The electrophotographic photosensitive member according to the present invention is characterized by: a photosensitive layer comprising an arylamine compound represented by the following formula (I):

(I)

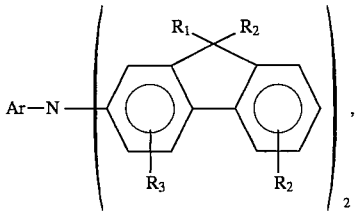

wherein Ar denote substituted or unsubstituted aryl group or substituted or unsubstituted heterocyclic group; $R_1$ and $R_2$ independently denote substituted or unsubstituted alkyl group, substituted or unsubstituted aralkyl group, or substituted or unsubstituted aryl group, $R_1$ and $R_2$ being capable of forming a ring by connection thereof; and $R_3$ and $R_4$ independently denote hydrogen atom, halogen atom, substituted or unsubstituted alkyl group, substituted or unsubstituted alkoxy group, or substituted or unsubstituted aryl group.

In the above formula (I), specific examples of Ar may include: aryl group such as phenyl, biphenyl (or diphenyl), naphthyl or fluorenyl; and heterocyclic group such as pyridyl, thienyl, furyl or quinolyl. Specific examples of $R_1$ and $R_2$ may include: alkyl group such as methyl, ethyl, propyl or butyl; aralkyl group such as benzyl or phenethyl; aryl group such as phenyl, biphenyl or naphthyl; and a ring formed by connection of $R_1$ and $R_2$ may include cyclopentane and cyclohexane. Specific examples of $R_3$ and $R_4$ may include: halogen atom such as fluorine, chlorine, bromine or iodine; alkyl group such as methyl, ethyl, propyl or butyl; alkoxy group such as methoxy, ethoxy, propoxy or butoxy; and aryl group such as phenyl, biphenyl or naphthyl.

Further, Ar and $R_1$ to $R_4$ in the formula (I) may respectively have a substituent such as halogen atom, alkyl group or alkoxy group as described above.

Hereinbelow, specific and preferred examples of the above-mentioned arylamine compound represented by the formula (I) may include those shown by the following structural formulas.

(1)

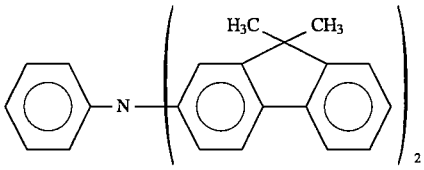

-continued (2)

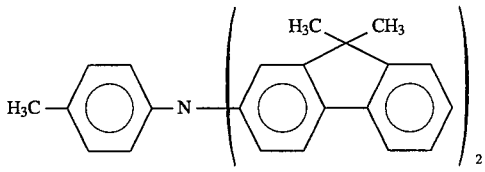

(3)

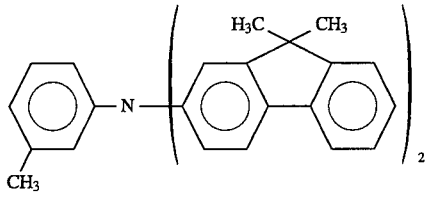

(4)

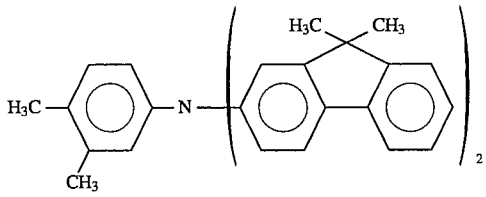

(5)

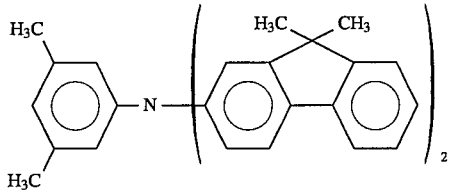

(6)

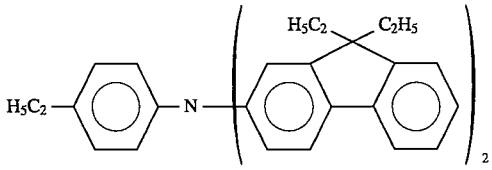

(7)

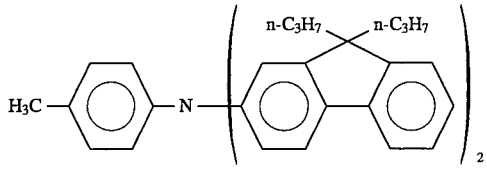

(8)

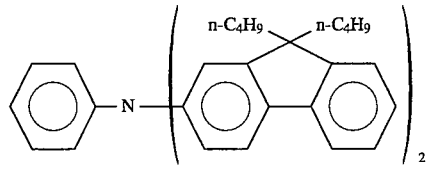

(9)

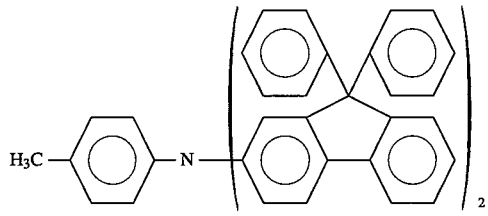

-continued
(10)
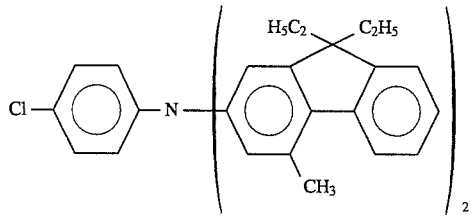
(11)
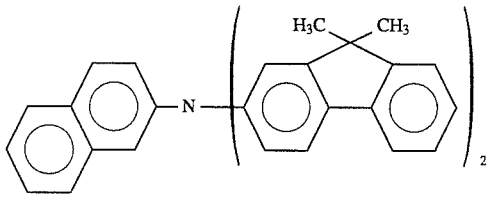
(12)
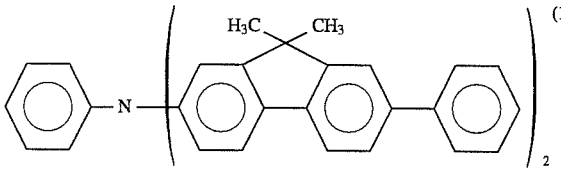
(13)
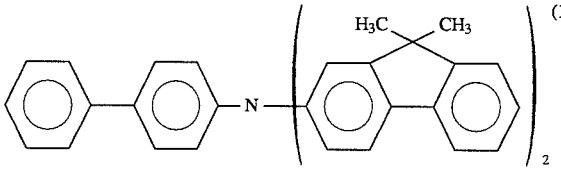
(14)
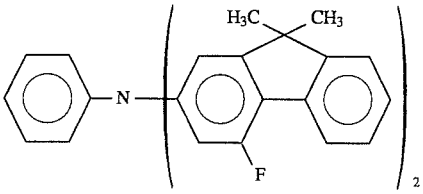
(15)
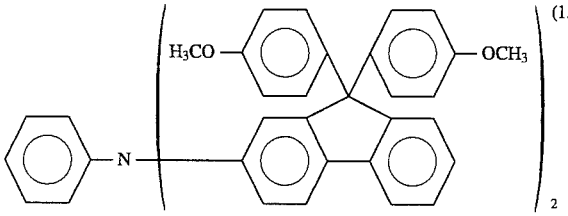
(16)
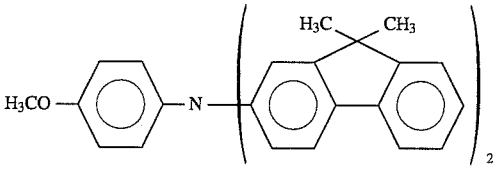
(17)
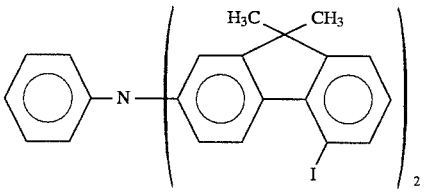
-continued
(18)
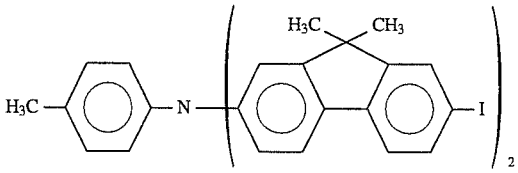
(19)
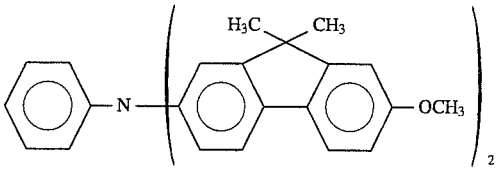
(20)
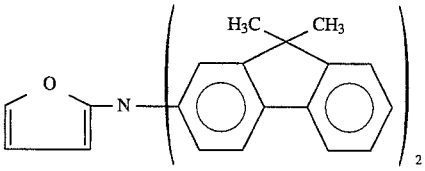
(21)
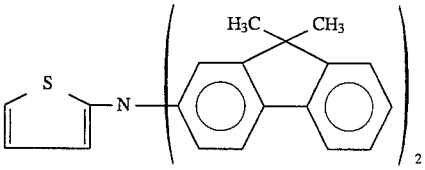
(22)
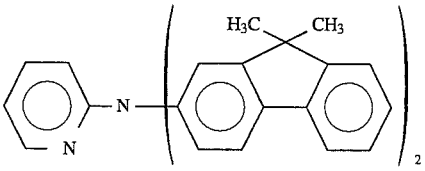
(23)
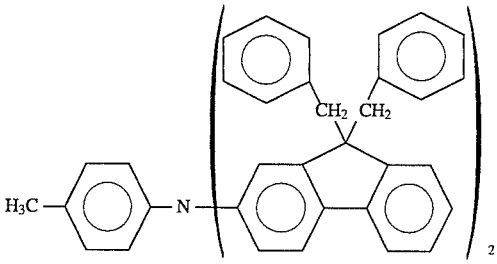
(24)
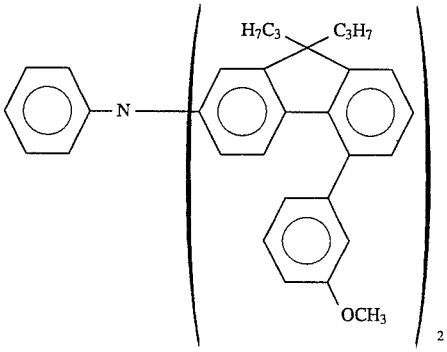
(25)
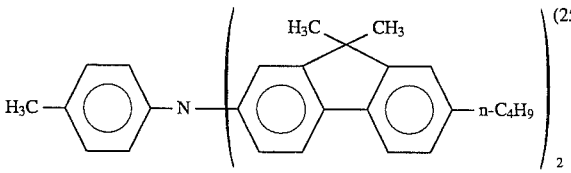

-continued (26)

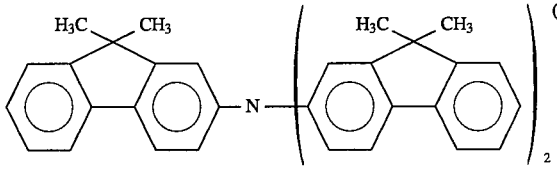

(27)

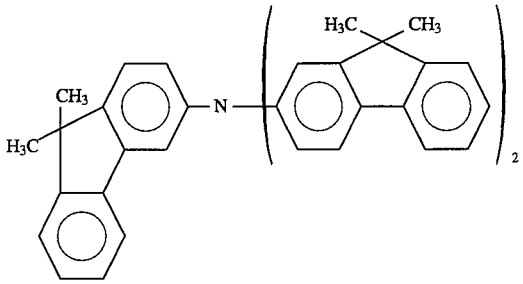

(28)

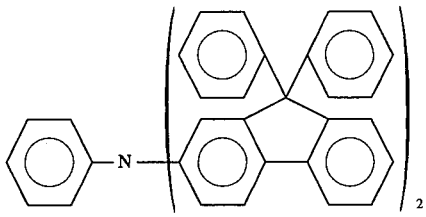

(29)

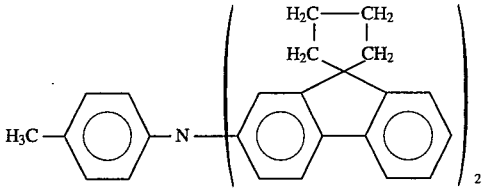

(30)

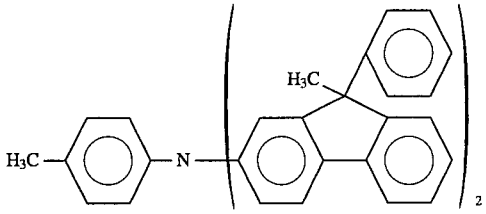

In the above arylamine compounds (Example Compound Nos. (1) to (30)), arylamine compounds of Ex. Comp. Nos. (1), (2), (3), (4), (5), (6), (16) and (29) may more preferably used in the present invention. Further, arylamine compounds of Ex. Comp. Nos. (2) and (4) are particularly preferred.

The arylamine compound of the formula (I) may, e.g., be prepared in the following manner.

Synthesis Example

Production of an arylamine compound (Ex. Comp. No. (2))

12.0 g (48.37 mM) of 9,9-dimethyl-2-iodofluorenone, 1.73 g (16.12 mM) of p-toluidine, 5.5 g of potassium carbonate anhydride, 3.5 g of copper powder and 7 ml of o-dichlorobenzene were mixed and stirred, followed by heat-refluxing for 20 hours under stirring in nitrogen atmosphere. After cooling at room temperature, the reaction mixture was subjected to filtration by means of suction, followed by distilling-off of o-dichlorobenzene from the filtrate under reduced pressure to obtain a crystal. The crystal was purified by silica gel column chromatography to obtain 1.40 g of an objective arylamine compound (Ex. Comp. No. (2)) (yield: 27.5%).

The thus obtained arylamine compound showed a melting point of 186.8–187.2 (° C.) and was subjected to elementary analysis, whereby the following results were obtained.

| Ex. Comp. No. (2): $C_{37}H_{33}N$ | | | |
|---|---|---|---|
| | C (%) | H (%) | N (%) |
| Calculated value | 90.39 | 6.77 | 2.85 |
| Measured value | 90.40 | 6.69 | 2.93 |

Further, the arylamine compound (Ex. Comp. No. (2)) was subjected to measurement of an infrared (IR) absorption spectrum according to KBr tablet method (Measurement Apparatus: 1600 Series FTIR, manufactured by Perkin Elmer Co.), whereby the IR absorption spectrum shown in FIG. 1 was obtained.

The photosensitive layer of the electrophotographic photosensitive member of the present invention may, e.g., include the following layer structure:

(1) A lower layer containing a charge-generating material and an upper layer containing a charge-transporting material;

(2) A lower layer containing a charge-transporting material and a upper layer containing a charge-generating material; and (3) A single layer containing a charge-generating material and a charge-transporting material.

The arylamine compound of the formula (I) has a high hole-transporting ability and accordingly may preferably be used as a charge-transporting material contained in a photosensitive layer having the above-mentioned layer structure of (1), (2) or (3). A polarity of a primary charge in a charging step of the photosensitive member of the present invention may preferably be negative for the layer structure (1), positive for the layer structure (2) and negative or positive for the layer structure (3).

The photosensitive layer used in the present invention may have another layer structure different from the above structures (1)–(3), as desired.

The photosensitive member of the present invention may preferably contain a photosensitive layer having the above-mentioned layer structure (1).

Hereinbelow, the photosensitive member containing such a photosensitive layer will be explained by way of preferred embodiment.

The photosensitive member comprises an electroconductive support, a charge generation layer (CGL) containing a charge-generating material (CGM), a charge transport layer (CTL) containing a charge-transporting material (CTM) in this order and optionally comprises an undercoating layer and/or a protective layer. The CGL and the CTL constitute a photosensitive layer as a whole.

The electroconductive support used in the invention may include:

(i) A metal or an alloy such as aluminum, aluminum alloy, stainless steel or copper;

(ii) A laminated or vapor-deposited support comprising a non-electroconductive substance, such as glass, resin or paper, or the above support (i), each having thereon a layer of a metal or an alloy such as aluminum, aluminum alloy, palladium, rhodium, gold or platinum; and (iii) A coated or vapor-deposited support comprising a non-electroconductive substance, such as glass, resin or paper, or the above support (i), each having thereon a layer of an electroconductive substance such as an electroconductive polymer, tin oxide or indium oxide.

The electroconductive support may be designed in various shapes, such as drum (or cylindrical) shape, sheet shape and belt shape, and may preferably be designed in a shape suitable for an apparatus to be applied.

The CGM contained in the CGL may include:

(i) Azo pigments of monoazo-type, bisazo-type, trisazo-type, etc.;

(ii) Phthalocyanine pigments such as metallo-phthalocyanine and non-metallophthalocyanine;

(iii) Indigo pigments such as indigo and thioindigo;

(iv) Perylene pigments such as perylenic anhydride and perylenimide;

(v) Polycyclic quinones such as anthraquinone and pyrene-1,8-quinone;

(vi) Squalium colorants (vii) Pyrylium salts and thiopyrylium salts;

(viii) Triphenylmethane-type colorants; and (ix) Inorganic substances such as selenium and amorphous silicon.

The above CGM may be used singly or in combination of two or more species.

In the present invention, the CGL may be formed on the electroconductive support by a dry process, such as vapor-deposition, sputtering or chemical vapor deposition (CVD), or by dispersing the CGM in an appropriate solution containing a binder resin and applying the resultant coating liquid onto the electroconductive support by means of a known coating method, such as dipping, spinner coating, roller coating, wire bar coating, spray coating or blade coating, and then drying the coating. Examples of the binder resin used may be selected from various known resins such as polycarbonate resin, polyester resin, polyarylate resin, polyvinyl butyral resin, polystyrene resin, polyvinyl acetal resin, diallylphthalate resin, acrylic resin, methacrylic resin, vinyl acetate resin, phenolic resin, silicone resin, polysulfone resin, styrene-butadiene copolymer, alkyd resin, epoxy resin, urea resin and vinyl chloride-vinyl acetate copolymer. These binder resins may be used singly or in combination of two or more species. The CGL may preferably contain at most 80 wt. %, particularly at most 40 wt. %, of the binder resin. The CGL may preferably have a thickness of at most 5 μm, particularly 0.01 to 2 μm.

The CGL may contain one or more known sensitizing agent, as desired.

The CTL according to the present invention may preferably be formed by dissolving the above-mentioned arylamine compound of the formula (I) in an appropriate solvent together with a binder resin, applying the resultant coating liquid such as solution onto a predetermined surface (e.g., the surface of an electroconductive support, charge generation layer, etc.) by the above-mentioned coating method, and then drying the resultant coating.

Examples of the binder resin to be used for forming the CTL may include: the resins used for the CGL described above; and organic photoconductive polymers such as poly-N-vinylcarbazole and polyvinylanthracene.

The CTM (i.e., the arylamine compound of the formula (I) may preferably be mixed with the binder resin in a proportion of 10 to 500 wt. parts, particularly 50 to 200 wt. parts, per 100 wt. parts of the binder resin.

The CTL and the CGL are electrically connected to each other. Accordingly, the CTM contained in the CTL has functions of receiving charge carriers generated in the CGL and transporting the charge carriers from the CGL or CTL to the surface of the photosensitive layer under electric field application.

The CTL may preferably have a thickness of 5 to 40 μm, particularly 10 to 30 μm. The CTL may contain further additives such as an antioxidant, an ultraviolet absorbing agent, a plasticizer, and a known CTM, as desired.

In a case where a photosensitive layer has a single layer structure (i.e., the above-mentioned structure (3)), the photosensitive layer may be prepared in the same manner as in the case of the CGL or CTL, and may preferably have a thickness of 5 to 40 μm, particularly 10 to 30 μm.

In the present invention, it is possible to dispose an undercoat layer having a barrier function and an adhesive function between the electrocondutive support and the photosensitive layer. Materials for the undercoat layer may include: casein, polyvinyl alcohol, nitrocellulose, polyamide (e.g., nylon 6, nylon 6.6, nylon 6.10, copolymer nylon, alkoxymethylated nylon), polyurethane and aluminum oxide. The undercoat layer may preferably have a thickness of at most 5 μm, particularly 0.1–3 μm.

Further, it is possible to dispose a protective layer on the photosensitive layer in order to protect the photosensitive layer from adverse influences exerted mechanically or chemically. Such a protective layer may be formed as a resin layer or a resinous layer containing electroconductive particles or a CTM.

The electrophotographic photosensitive member according to the present invention can be applied to not only an ordinary electrophotographic copying machine but also a facsimile machine, a laser beam printer, a light-emitting diode (LED) printer, a cathode-ray tube (CRT) printer, and other fields of applied electrophotography including, e.g., an electrophotographic plate making system.

Figure 2:
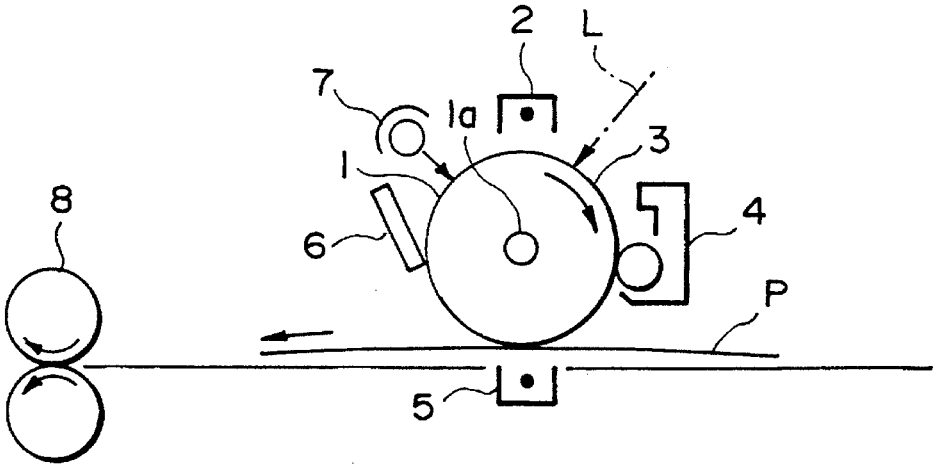
FIG. 2 is a schematic structural view of an embodiment of an electrophotographic apparatus using an electrophotographic photosensitive member according to the present invention.

FIG. 2 shows a schematic structural view of an electrophotographic apparatus using an electrophotographic photosensitive member of the invention. Referring to FIG. 2, a photosensitive drum (i.e., photosensitive member) 1 as an image carrying member is rotated about an axis 1*a* at a prescribed peripheral speed in the direction of the arrow shown inside of the photosensitive drum 1. The surface of the photosensitive drum is uniformly charged by means of a charger (charging means) 2 to have a prescribed positive or negative potential. At an exposure part 3, the photosensitive drum 1 is exposed to light-image L (as by slit exposure or laser beam-scanning exposure) by using an image exposure means (not shown), whereby an electrostatic latent image corresponding to an exposure image is successively formed on the surface of the photosensitive drum 1. The electrostatic latent image is developed by a developing means 4 to form a toner image. The toner image is successively transferred to a transfer material P which is supplied from a supply part (not shown) to a position between the photosensitive drum 1 and a transfer charger (transfer means) 5 in synchronism with the rotating speed of the photosensitive drum 1, by means of the transfer charger 5. The transfer material P with the toner image thereon is separated from the photosensitive drum 1 to be conveyed to a fixing device 8, followed by image fixing to print out the transfer material P as a copy outside the electrophotographic apparatus. Residual toner particles on the surface of the photosensitive drum 1 after the transfer are removed by means of a cleaner (cleaning means) 6 to provide a cleaned surface, and residual charge on the surface of the photosensitive drum 1 is erased by a pre-exposure means 7 to prepare for the next cycle. As the charger 2 for charging the photosensitive drum 1 uniformly, a corona charger is widely used in general. As the transfer charger 5, such a corona charger is also widely used in general.

According to the present invention, in the electrophotographic apparatus, it is possible to provide a process cartridge which includes plural means inclusive of or selected from the photosensitive member 1 (photosensitive drum), the charger 2, the developing means 4, the cleaner 6, etc. so as to be attachable and detachable, as desired. The process cartridge may, for example, be composed of the photosensitive member and at least one device of the charger, the developing means and the cleaner integrally supported to form a single cartridge capable of being attached to or detached from the body of an electrophotographic apparatus, such as a copying machine or a laser beam printer, by using a guiding means such as a rail in the body.

In case where the electrophotographic apparatus is used as a copying machine or a laser beam printer, exposure light-image L may be given by reading a data on reflection light or transmitted light from an original or reading a data on the original by means of a sensor, converting the data into a signal and then effecting a laser beam scanning a drive of LED array or a drive of a liquid crystal shutter array in accordance with the signal so as to expose the photosensitive member to the light-image L.

Figure 3:
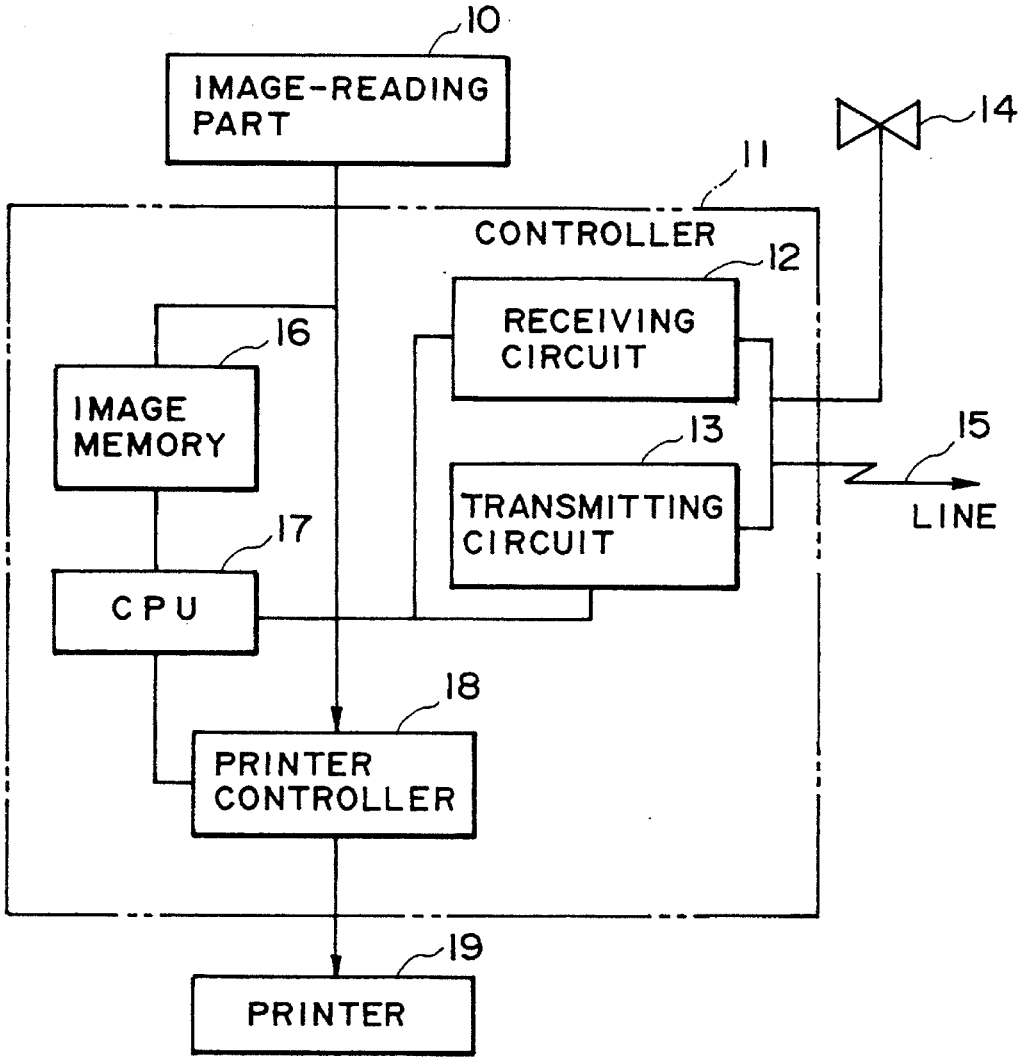
FIG. 3 is a block diagram of a facsimile machine using an electrophotographic apparatus according to the present invention as a printer.

In case where the electrophotographic apparatus according to the present invention is used as a printer of a facsimile machine, exposure light-image L is given by exposure for printing received data. FIG. 3 shows a block diagram of an embodiment for explaining this case. Referring to FIG. 3, a controller 11 controls an image-reading part 10 and a printer 19. The whole controller 11 is controlled by a CPU (central processing unit) 17. Read data from the image-reading part is transmitted to a partner station through a transmitting circuit 13, and on the other hand, the received data from the partner station is sent to the printer 19 through a receiving circuit 12. An image memory 16 memorizes prescribed image data. A printer controller 18 controls the printer 19, and a reference numeral 14 denotes a telephone handset.

The image received through a line 15 (the image data sent through a line from a connected remote terminal) is demodulated by means of the receiving circuit 12 and successively stored in an image memory 16 after a restoring-signal processing of the image data. When image for at least one page is stored in the image memory 16, image recording of the page is effected. The CPU 17 reads out the image data for one page from the image memory 16 and sends the image data for one page subjected to the restoring-signal processing to the printer controller 18. The printer controller 18 receives the image data for one page from the CPU 17 and controls the printer 19 in order to effect image-data recording. Further, the CPU 17 is caused to receive image for a subsequent page during the recording by the printer 19. As described above, the receiving and recording of the image are performed.

Hereinbelow, the present invention, will be explained more specifically with reference to examples.

EXAMPLE 1

A coating liquid for a charge generation layer (CGL) was prepared by adding 4.6 g of a bisazo pigment of the formula:

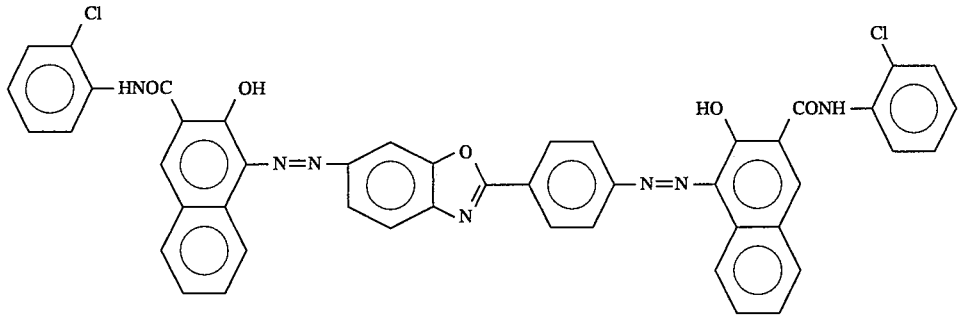

to a solution of 2 g of a butyral resin (butyral degree of 68 mol. %; weight-average molecular weight (Mw)=35,000) in 100 ml of cyclohexanone and dispersing for 36 hours by means of a sand mill.

The coating liquid for the CGL was applied onto an aluminum sheet by a wire bar and dried to obtain a 0.2 μm-thick CGL.

Then, 8 g of an arylamine compound of the formula (I) (Ex. Comp. No. (2)) and 10 g of a polycarbonate resin (Mw=25,000) were dissolved in 70 g of mono-chlorobenzene to prepare a coating liquid.

The coating liquid was applied onto the above-prepared CGL by means of a wire bar, followed by drying to form a charge transport layer (CTL) having a thickness of 20 microns whereby an electrophotographic photosensitive member according to the present invention was prepared.

The thus prepared photosensitive member was negatively charged by using corona (−5 KV) according to a static method by means of an electrostatic copying paper tester (Model: SP-428, mfd. by Kawaguchi Denki K. K.) and retained in a dark place for 1 sec. Thereafter, the photosensitive member was exposed to halogen light at an illuminance of 20 lux to evaluate charging characteristics. More specifically the charging characteristics were evaluated by measuring a surface potential ($V_0$) at an initial stage (i.e., immediately after the charging), a surface potential ($V_1$) obtained after a dark decay for 1 sec, and an exposure quantity ($E_{1/5}$: lux.sec) (i.e., sensitivity) required for decreasing the potential $V_1$ to ⅕ thereof.

In order to evaluate potential characteristics in repetitive use, a photosensitive member prepared in the same manner as above except that the aluminum sheet was changed to an aluminum cylinder (80 mmϕ×360 mm) and a dip coating method was applied was installed in a plane paper copying machine ("NP-3825", manufactured by Canon K. K.) and subjected to a copying test (or a durability test) of 5,000 sheets on condition that a dark part potential ($V_D$) and a light part potential ($V_L$) at an initial stage were set to −700 V and −200 V, respectively.

Potentials including $V_D$, $V_L$ and a surface potential after the pre-exposure (i.e., residual potential ($V_R$)) were measured at the initial stage and after the copying test of 5000 sheets respectively, to evaluate the potential characteristics.

After the above copying test, the photosensitive member was left standing for 3 days within the copying machine. Then, dark part potentials at a position immediately under the corona charger and another position (i.e., a position different from the position immediately under the corona charger) were measured to obtain a difference therebetween ($\Delta V_D$), thus evaluating "pause memory characteristic (phenomenon)".

The photosensitive member was also subjected to an accelerated test of a crack in a photosensitive layer as follows.

The surface of a photosensitive member as prepared above was touched or pressed by a finger to attach a fatty component of the finger to the surface of the photosensitive member, followed by standing for 8 hours under normal temperature and normal pressure. After a lapse of a prescribed hour, the touched part of the photosensitive member is subjected to observation with a microscope (VERSAMET 6390, manufactured by Union Corp.; magnification =50) whether a crack is caused to occur or not.

Evaluation standards for the crack in the photosensitive layer were as follows.

o: No crack was observed at all.

x: A crack was observed slightly or noticeably.

The results are summarized in Table 1 appearing hereinafter.

EXAMPLES 2–10

Photosensitive members were prepared and evaluated in the same manner as in Example 1 except that a bisazo pigment (as a charge-generating material) of the formula:

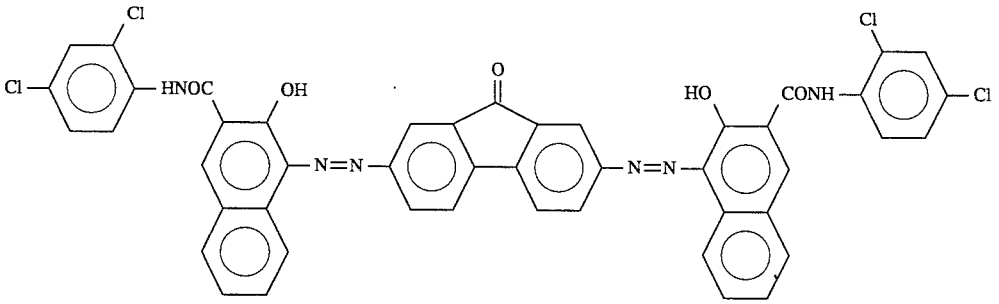

and arylamine compounds (Example Compounds) (as a charge-transporting material) indicated in Table 1 were used, respectively, whereby the following results were obtained.

TABLE 1

| Ex. No. | Ex. Comp. No. | $V_0$(−V) | $V_1$(−V) | $E_{1/5}$ (lux. sec) | Initial −V $V_D$ | Initial −V $V_L$ | Initial −V $V_R$ | After 5000 sheets (−V) $V_D$ | After 5000 sheets (−V) $V_L$ | After 5000 sheets (−V) $V_R$ | $\Delta V_D$ (V) | Crack in photosensitive layer 1 hr | 2 hr | 4 hr | 8 hr |
|---|---|---|---|---|---|---|---|---|---|---|---|---|---|---|---|
| 1 | (2) | 721 | 710 | 1.6 | 700 | 200 | 25 | 696 | 209 | 32 | 4 | o | o | o | o |
| 2 | (1) | 723 | 712 | 1.3 | 700 | 200 | 20 | 692 | 204 | 28 | 5 | o | o | o | o |
| 3 | (3) | 715 | 701 | 1.1 | 700 | 200 | 18 | 697 | 210 | 25 | 7 | o | o | o | o |
| 4 | (4) | 708 | 697 | 0.9 | 700 | 200 | 25 | 693 | 204 | 38 | 11 | o | o | o | o |
| 5 | (6) | 711 | 697 | 1.2 | 700 | 200 | 26 | 688 | 207 | 37 | 4 | o | o | o | o |
| 6 | (7) | 729 | 717 | 1.2 | 700 | 200 | 20 | 695 | 205 | 32 | 6 | o | o | o | o |
| 7 | (8) | 700 | 685 | 1.2 | 700 | 200 | 23 | 691 | 208 | 37 | 10 | o | o | o | o |
| 8 | (15) | 706 | 692 | 1.3 | 700 | 200 | 19 | 687 | 212 | 35 | 9 | o | o | o | o |
| 9 | (16) | 728 | 715 | 1.1 | 700 | 200 | 32 | 690 | 209 | 44 | 9 | o | o | o | o |
| 10 | (19) | 703 | 690 | 1.2 | 700 | 200 | 27 | 691 | 215 | 39 | 6 | o | o | o | o |

Comparative Examples 1–6

Photosensitive members were prepared and evaluated in the same manner as in Example 2 except for using the following comparative compounds (1) (6) as a charge-transporting material, respectively.

Comparative Compound No.

(1)

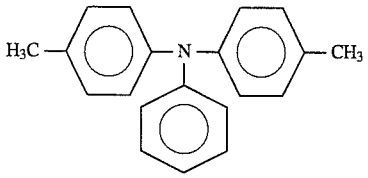

(2)

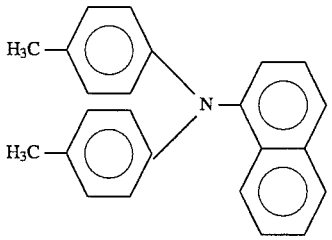

-continued

Comparative Compound No.

(3)

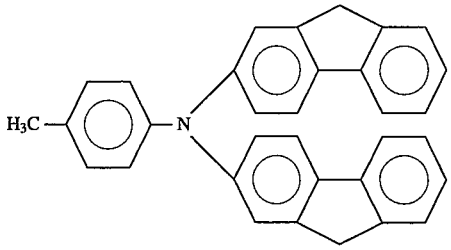

(4)

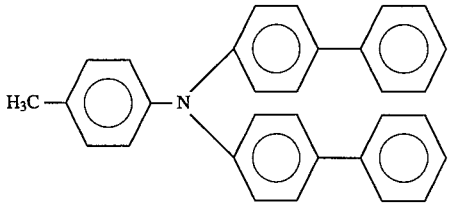

(5)

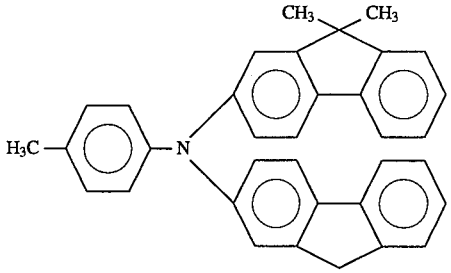

(6)

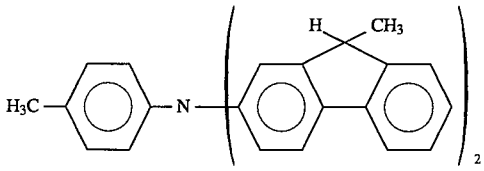

The results are shown in Table 2 below.

layer by blade coating, followed by drying to form a 0.3 micron-thick CGL.

Then, 7 g of an arylamine compound (Ex. Comp. No. (5)) and 10 g of a polymethylmethacrylate resin (Mw=45,000) were dissolved in 70 g of monochlorobenzene. The solution was applied onto the CGL by blade coating and dried to form a 25 microns-thick CTL to prepare an electrophotographic photosensitive member of the present invention.

The thus prepared photosensitive member was charged by using corona discharge (−5 KV) so as to have an initial surface potential ($V_0$), left standing in a dark place for 1 sec, and thereafter the surface potential thereof ($V_1$) was measured. In order to evaluate a photosensitivity the exposure quantity ($E_{1/5}$, μJ/cm$^2$) required for decreasing the potential $V_1$ after the dark decay to ⅕ thereof was measured. The light source used in this example was laser light (output: 5 mW emission wavelength: 780 nm) emitted from a ternary semiconductor comprising gallium/aluminum/arsenic.

A photosensitive member prepared in the same manner as above except that the aluminum sheet was changed to an aluminum cylinder (80 mmϕ×360 mm) and a dip coating method was applied was installed in a laser beam printer (trade name: LBP-SX, mfd. by Canon K. K.) equipped with the above-mentioned semiconductor laser using a reversal development system, and subjected to image formation and thus was evaluated in the same manner as in Example 1.

The image formation conditions used herein were as follows:

surface potential after primary charging ($V_D$): −700 V surface potential after image exposure ($V_L$): −150 V (exposure quantity: 0.7 μJ/cm$^2$)

transfer potential: +700 V polarity of developing: negative process speed: 50 mm/sec developing condition (developing bias): −450 V

TABLE 2

| Comp. Ex. | Comparative Comp. | | | $E_{1/5}$ | Initial (−V) | | | After 5000 sheets (−V) | | | $\Delta V_D$ | Crack in photosensitive layer | | | |
|---|---|---|---|---|---|---|---|---|---|---|---|---|---|---|---|
| No. | No. | $V_0$(−V) | $V_1$(−V) | (lux. sec) | $V_D$ | $V_L$ | $V_R$ | $V_D$ | $V_L$ | $V_R$ | (V) | 1 hr | 2 hr | 4 hr | 8 hr |
| 1 | (1) | 700 | 689 | 3.5 | 700 | 200 | 28 | 674 | 321 | 66 | 105 | o | o | o | x |
| 2 | (2) | 698 | 685 | 3.2 | 700 | 200 | 33 | 677 | 218 | 57 | 117 | o | o | x | x |
| 3 | (3) | 703 | 692 | 1.3 | 700 | 200 | 25 | 696 | 207 | 62 | 110 | o | o | o | x |
| 4 | (4) | 709 | 698 | 3.5 | 700 | 200 | 31 | 687 | 258 | 57 | 96 | o | x | x | x |
| 5 | (5) | 705 | 685 | 1.5 | 700 | 200 | 30 | 680 | 215 | 65 | 100 | o | o | o | x |
| 6 | (6) | 704 | 690 | 1.4 | 700 | 200 | 30 | 675 | 218 | 68 | 90 | o | o | o | x |

EXAMPLE 11

Onto an aluminum sheet, a solution of 4 g of an N-methoxymethylated 6-nylon resin (Mw=32,000) and 10 g of an alcohol-soluble copolymer nylon resin (Mw=29,000) in 100 g of methanol was applied by means of a wire bar, followed by drying to form a 1 micron-thick undercoating layer.

Separately, 10 g of oxytitanium phthalocyanine was added to a solution of 5 g of a butyral resin (butyral degree of 68 mol. %; Mw=35,000) in 90 g of dioxane and the resultant mixture was dispersed for 24 hours in a ball mill. The liquid dispersion was applied onto the undercoating scanning system after image exposure: image scanning exposure prior to the primary charging: 40 lux.sec (whole surface exposure using red light)

The results are shown in Table 3 appearing hereinafter.

EXAMPLE 12

A 6%-solution of an alcohol-soluble nylon resin (nylon 6-66-610-12 tetrapolymer: Mw=30,000) in methanol was applied onto an aluminum sheet and dried to form an undercoat layer having a thickness of 0.5 μm.

Then, 6 g of a pigment of the formula:

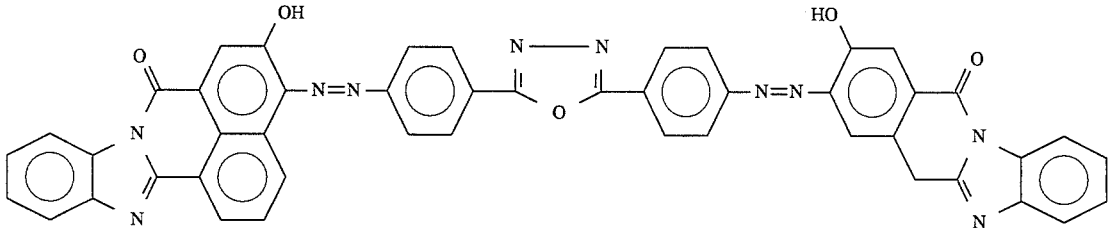

was added to 100 ml of tetrahydrofuran, followed by stirring for 48 hours in a sand mill to prepare a dispersion.

A solution of 5 g of an arylamine compound (Ex. Comp. No. (11)) and 10 g of a bisphenol A-type polycarbonate resin (Mw=20,000) in 40 g of a mixture solvent of monochlorobenzene/dichloromethane (3/1 by weight) was added to the above dispersion, followed by stirring for 3 hours in the sand mill. The thus prepared dispersion was applied onto the above-prepared undercoat layer by a wire bar, followed by drying to form a 20 μm-thick photosensitive layer to prepare an electrophotographic photosensitive member of the present invention.

The thus-prepared photosensitive member was evaluated in the same manner as in Example 1. The results are shown in Table 3 below.

TABLE 3

| Ex. No. | Ex. Comp. No. | $V_0$(−V) | $V_1$(−V) | $E_{1/5}$ | Initial (−V) $V_D$ | Initial (−V) $V_L$ | Initial (−V) $V_R$ | After 5000 sheets (−V) $V_D$ | After 5000 sheets (−V) $V_L$ | After 5000 sheets (−V) $V_R$ | $\Delta V_D$ (V) | Crack in photosensitive layer 1 hr | 2 hr | 5 hr | 8 hr |
|---|---|---|---|---|---|---|---|---|---|---|---|---|---|---|---|
| 11 | (5) | 718 | 703 | 1.4 (μJ/cm²) | 700 | 150 | 65 | 694 | 156 | 70 | 7 | ○ | ○ | ○ | ○ |
| 12 | (11) | 713 | 701 | 2.8 (lux. sec) | 700 | 200 | 35 | 695 | 154 | 40 | 5 | ○ | ○ | ○ | ○ |

What is claimed is:

1. An electrophotographic photosensitive member, comprising: an electroconductive support and a photosensitive layer disposed on the electroconductive support, wherein said photosensitive layer contains an arylamine compound represented by the following formula (I)

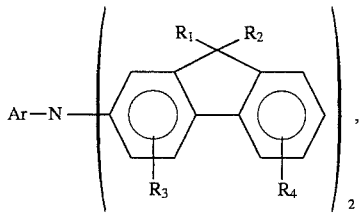

(I)

wherein Ar denotes substituted or unsubstituted aryl group or substituted or unsubstituted heterocyclic group; $R_1$ and $R_2$ independently denote substituted or unsubstituted alkyl group, substituted or unsubstituted aralkyl group, or substituted or unsubstituted aryl group, $R_1$ and $R_2$ being capable of forming a ring by connection thereof; and $R_3$ and $R_4$ independently denote hydrogen atom, halogen atom, substituted or unsubstituted alkyl group, substituted or unsubstituted alkoxy group, or substituted or unsubstituted aryl group.

2. A member according to claim 1, wherein said arylamine compound of the formula (I) is selected from the group consisting of:

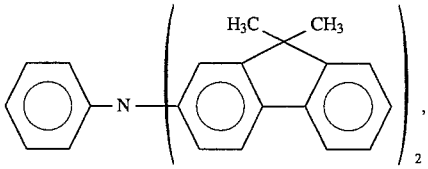

-continued

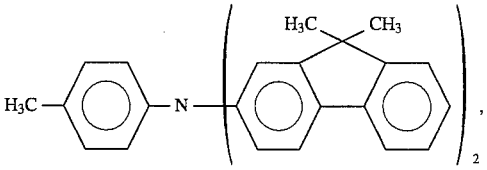

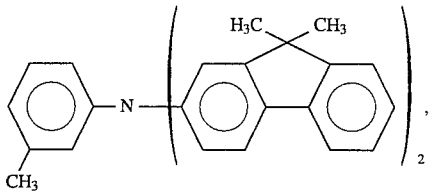

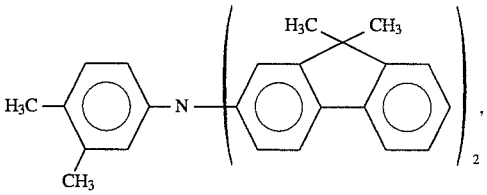

-continued

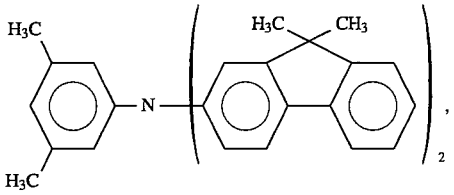

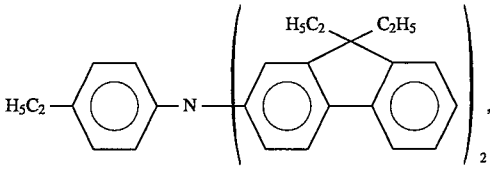

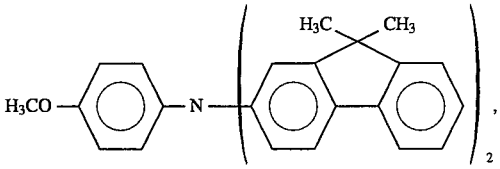

and

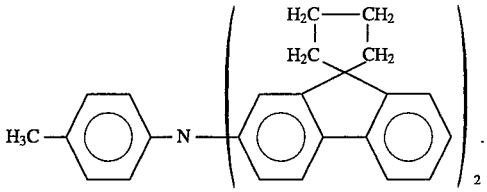

3. A member according to claim 2, wherein said arylamine compound of the formula (I) is

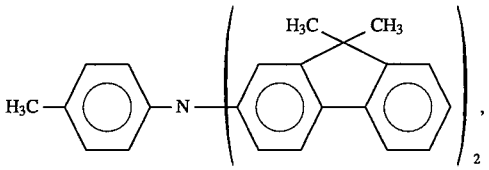

or

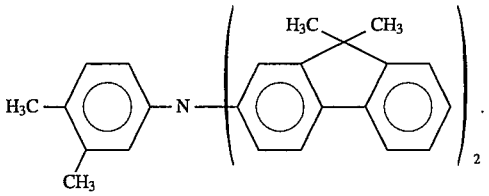

4. A member according to claim 1, wherein said photosensitive layer comprises a charge generation layer and a charge transport layer.

5. A member according to claim 4, wherein said charge transport layer is disposed on said charge generation layer.

6. A process cartridge, comprising: an electrophotographic photosensitive member according to claim 1 and at least one means selected from charging means, developing means, and cleaning means;

wherein said photosensitive member, and said at least one means selected from the charging means, the developing means, and the cleaning means are integrally supported to form a single cartridge, which can be attached to or detached from an apparatus body as desired.

7. An electrophotographic apparatus, comprising: an electrophotographic photosensitive member according to claim 1, charging means, image-exposure means, developing means and transfer means.

* * * * *

UNITED STATES PATENT AND TRADEMARK OFFICE

CERTIFICATE OF CORRECTION

PATENT NO. : 5,510,218

DATED : April 23, 1996

INVENTOR(S) : KOUICHI NAKATA ET AL.

It is certified that error appears in the above-identified patent and that said Letters Patent is hereby corrected as shown below:

On the title page: Item

AT [56] REFERENCES CITED

Foreign Patent Documents,
"55-52063 4/1990 Japan." should read
--55-52063 4/1980 Japan.--.

COLUMN 1

Line 57, "is" should be deleted.
Line 60, "an" should be deleted.

COLUMN 2

Line 43, "$|_{R_2}$" should read --$|_{R_4}$--.

COLUMN 3

Line 23, "$|_{R_2}$" should read --$|_{R_4}$--.
Line 25, "denote" should read --denotes--.

COLUMN 7

Line 47, "used" should read --be used--.

COLUMN 8

Line 44, "preferred" should read --the preferred--.

UNITED STATES PATENT AND TRADEMARK OFFICE

CERTIFICATE OF CORRECTION

PATENT NO. : 5,510,218

DATED : April 23, 1996

INVENTOR(S) : KOUICHI NAKATA ET AL.

It is certified that error appears in the above-identified patent and that said Letters Patent is hereby corrected as shown below:

COLUMN 9

Line 15, "Squalium colorants" should read --Squarilium colorant;--.
Line 44, "agent," should read --agents,--.
Line 58, "(I)" should read --(I))--.

COLUMN 11

Line 66, "invention," should read --invention--.

COLUMN 12

Line 35, "microns" should read --microns,--.
Line 44, "specifically" should read --specifically,--.

COLUMN 13

Line 67, "compounds (1)(6)" should read --compounds (1)-(6)--.

COLUMN 16

Line 14, "photosensitivity" should read --photosensitivity,--.
Line 17, "5 mW" should read 5 mW,--.

UNITED STATES PATENT AND TRADEMARK OFFICE

CERTIFICATE OF CORRECTION

PATENT NO. : 5,510,218

DATED : April 23, 1996

INVENTOR(S) : KOUICHI NAKATA ET AL.

It is certified that error appears in the above-identified patent and that said Letters Patent is hereby corrected as shown below:

COLUMN 20

Line 37, insert

--8. A member according to claim 1, wherein at least one of $R_3$ and $R_4$ in the formula (I) is hydrogen.

9. A cartridge according to claim 6, wherein at least one of $R_3$ and $R_4$ in the formula (I) is hydrogen.

10. An apparatus according to claim 7, wherein at least one of $R_3$ and $R_4$ in the formula (I) is hydrogen.--.

Signed and Sealed this

Fifteenth Day of October, 1996

Bruce Lehman

*Attest:*

BRUCE LEHMAN

*Attesting Officer*

*Commissioner of Patents and Trademarks*